United States Patent [19]

Sheahan

[11] Patent Number: 4,700,719

[45] Date of Patent: Oct. 20, 1987

[54] CONTROL OF CIGARETTE ROD FORMATION

[75] Inventor: Michael H. Sheahan, Toronto, Canada

[73] Assignee: Rothmans of Pall Mall Limited, North York, Canada

[21] Appl. No.: 862,700

[22] Filed: May 13, 1986

[30] Foreign Application Priority Data

May 15, 1985 [GB] United Kingdom ..... 8512293
Jul. 25, 1985 [GB] United Kingdom ..... 8518782

[51] Int. Cl.[4] ..... A24C 5/39; A24C 5/18

[52] U.S. Cl. ..... 131/84.4; 131/84.1; 131/108; 131/909; 131/109.1

[58] Field of Search ..... 131/84.1, 84.5, 84.4, 131/108, 109.1, 109.2, 109.3, 110, 909

[56] References Cited

U.S. PATENT DOCUMENTS

| | | | |
|---|---|---|---|
| 3,431,914 | 3/1969 | Richter | 131/108 |
| 3,980,088 | 9/1976 | Brackmann et al. | 131/110 |
| 4,095,604 | 6/1978 | Labbe | 131/109.1 |
| 4,499,909 | 2/1985 | Seragnoli | 131/84.1 |
| 4,595,026 | 6/1986 | Mattei | 131/84.3 |
| 4,605,013 | 8/1986 | Goldbach | 131/108 |
| 4,616,662 | 10/1986 | Hartmann et al. | 131/84.3 |

FOREIGN PATENT DOCUMENTS

| | | | |
|---|---|---|---|
| 2124471 | 2/1984 | United Kingdom | 131/109.3 |

*Primary Examiner*—V. Millin
*Assistant Examiner*—H. Macey
*Attorney, Agent, or Firm*—Sim McBurney

[57] ABSTRACT

Tobacco trimmed from a filler rod is recycled and used in the control of the rod-forming operation. A reservoir vessel is divided into physically-separate chambers, a narrow one of which receives the recycled trimmed tobacco and a wider one of which receives cut tobacco. Tobacco is simultaneously fed from both chambers by a common feeding device to form a metered flow from which the filler rod is ultimately formed. The level of tobacco in the narrow chamber is sensed and the operation of the common feeding device is controlled in response to sensed levels outside a predetermined range. If the sensed level is too high, then the tobacco is being fed too fast to the rod formation and the common feeding device then is slowed down, thereby slowing the tobacco feed rate, while, if the sensed level is too low, then the tobacco is being fed too slowly to the rod formation and the common feeding device then is speeded up, thereby speeding up the tobacco feed rate.

18 Claims, 1 Drawing Figure

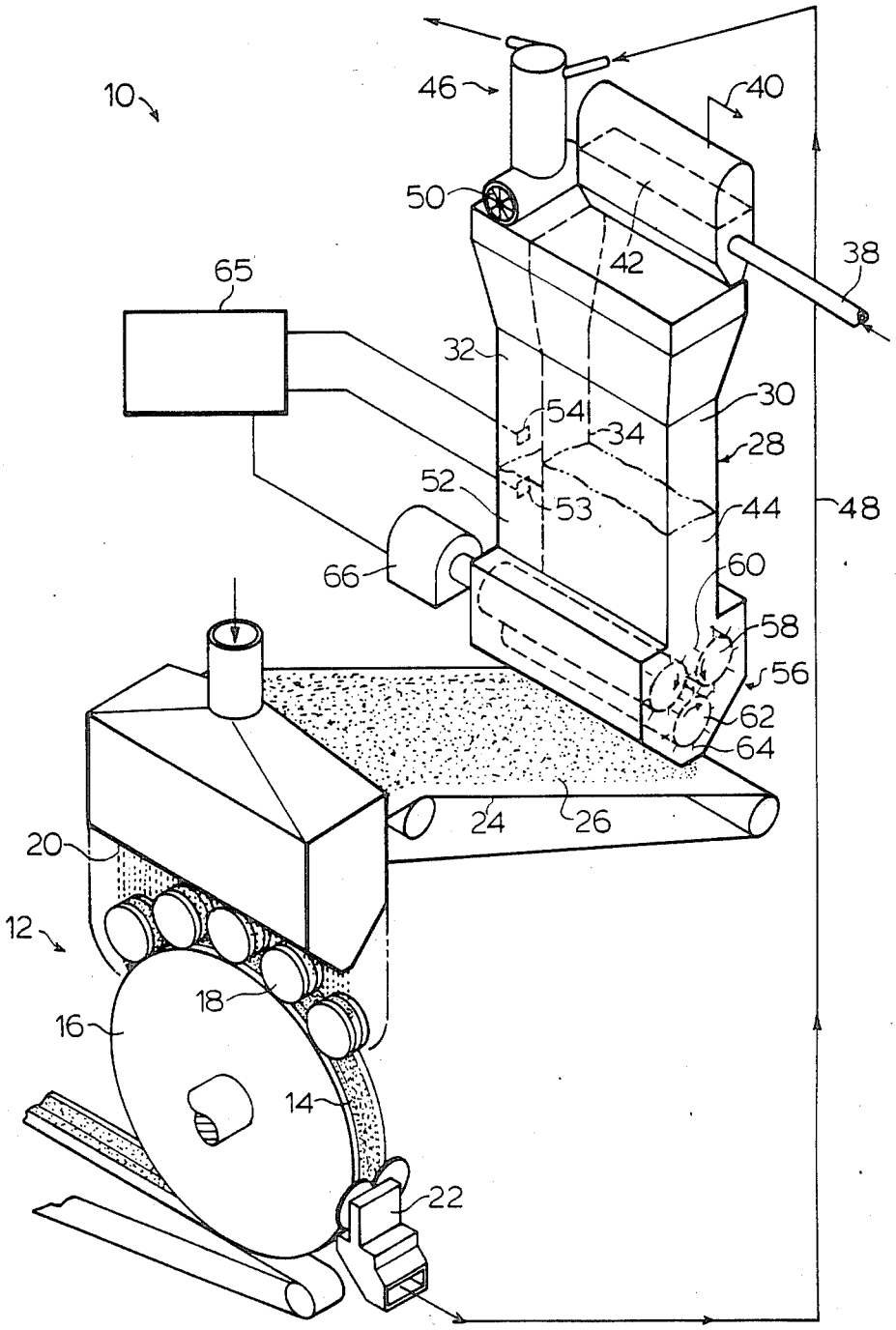
10
46
40
50
42
38
65
32
30
54
34
28
52
53
44
48
66
60
58
56
62
64
24
26
20
12
18
16
14
22

CONTROL OF CIGARETTE ROD FORMATION

FIELD OF INVENTION

The present invention relates to the control of cigarette rod formation, more particularly to the utilization of the recycle of trimmed tobacco as a control mechanism.

BACKGROUND OF THE INVENTION

In the manufacture of cigarettes, cut tobacco is metered from a reservoir or hopper of tobacco to provide a metered flow, a vertically-moving thin shower of tobacco particles is formed from the metered flow, a tobaco filler rod is formed from the shower of tobacco particles, and a paper web is wrapped around the tobacco filler rod.

Since there is a tendency for the tobacco filler rod to have variable quantities of tobacco at various locations along its length, giving rise to a variable thickness, there is usually first formed from the shower of tobacco particles a rod of tobacco particles containing a greater quantity in the cross-section thereof over that ultimately required in the tobacco filler rod, and excess tobacco is trimmed from the rod of tobacco particles to provide the tobacco filler rod for wrapping and trimmed tobacco. This procedure of overfeeding and then trimming ensures that all locations along the length of the rod have the thickness of tobacco required to form the cigarette.

Trimmed tobacco usually is recycled to the hopper of tobacco from which the metered flow is formed. The metered flow of tobacco from which the tobacco shower is formed generally is provided from a tobacco hopper with some form of refuser mechanism, such as carding drums, to control and meter the quantity of tobacco which passes to the rod-forming operation from the hopper. Such refuser mechanisms, which may also involve recycle of tobacco to the hopper, result in degradation of tobacco, thereby impairing the filling power of the tobacco.

In most cigarette-making machines, the feeder speed, i.e. the refuser roll metering, is not normally continuously controlled but rather is preset to a desired average flow rate and, as a result of variations in density, the mosture content of the tobacco, particle size and similar variations, variable flow rates of tobacco occur, leading to variations in quantities of tobacco trimmed. Any tobacco which is trimmed becomes degraded, thereby impairing its filling power, and hence it is desirable to control the amount of trimming to take into account the variations noted above.

Prior attempts have been made to use trimmed tobacco as a rod-formation control. In U.S. Pat. No. 3,431,914, there is described a procedure in which trimmed tobacco is fed to a storage vessel, tobacco from the storage vessel is returned to the rod of tobacco particles formed from the shower, and the amount of tobacco withdrawn from the storage vessel and recycled is regulated in accordance with testing the quantity of tobacco in the filler rod after trimming or the rod of tobacco particles before trimming. In addition, the amount of trimmed tobacco in the storage vessel is sensed, with the amount of rising and falling dependent on the amount of excess tobacco trimmed. If the amount of tobacco in the storage vessel is sensed to be too great, then the mechanism for forming the vertically-moving tobacco shower is regulated to decrease the tobacco feed rate. The rate of removal of the tobacco from the trimmed tobacco storage vessel, however, is controlled by measurements conducted on the rod prior to or after trimming. Two independent measurements are made and two different operational controls result from these measurements.

U.S. Pat. No. 4,095,604 describes a tobacco metering device which comprises a generally vertically-extending thin and laterally-wide channel in which tobacco particles fed from a hopper by a carding drum and picker combination pile up to form a carpet between the front and rear wall of the channel. One of the walls of the channels is movable to permit the carpet of tobacco to be fed downwards through the channel and a conveyor is provided at the lower end of the channel for forwarding the carpet towards the formation of the vertically-moving shower.

In one embodiment of this prior art device, trimmed tobacco is fed into the upper end of the channel across one part of the width of the channel while new tobacco from the hopper is fed across the remainder of the width of the channel, so that the carpet of tobacco in the channel is formed of side-by-side portions of new tobacco and recycled trimmed tobacco. Provided at the lower end of the channel are a pair of independently-operated carding rollers, so as to feed tobacco independently from the side-by-side portions of the carpet. The height of tobacco in the side-by-side portions of the carpet is independently sensed and such sensings are used to control independently the speed of the carding rollers to maintain the levels of the side-by-side portions within predetermined levels.

In this prior art device, therefore, recycled trimmed and new tobacco are provided side-by-side in a carpet confined between vertical front and rear walls, the height of the respective portions is sensed and the flow rate of tobacco from the respective portions is independently controlled as a result of independent measurements.

As far as the applicant is aware, there has been no published attempt to use the feed rate of recycled trimmed tobacco as the control mechanism for the metering of cut tobacco from a reservoir thereof to form a metered flow.

SUMMARY OF INVENTION

In accordance with the present invention, the recycle of trimmed tobacco is used to control the rate of feed of tobacco to the rod-formation procedure. The feed rate control which is achieved in the present invention can be used to avoid the necessity for the utilization of refuser mechanisms and the tobacco degradation that results therefrom. In the present invention, the only tobacco recycled within the rod-forming procedure is the tobacco which is trimmed from the rod. In addition, the present invention avoids the necessity to make multiple measurements of tobacco reservoir levels and independent changes in flow rates of different streams based upon such measurements.

Accordingly, the present invention provides an improvement in a method of forming a tobacco filler rod suitable for formation of cigarettes therefrom wherein cut tobacco is metered from a reservoir thereof to provide a metered flow, a vertically-moving shower of tobacco particles is formed from the metered flow, a rod of tobacco particlaes is formed from the shower and contains a greater quantity of tobacco in the cross-section thereof than is required in the tobacco filler rod, excess tobacco is trimmed from the rod of tobacco particles to provide the tobacco filler rod and trimmed tobacco, and the trimmed tobacco is recycled to the reservoir of cut tobacco.

The improvement of the present invention resides in a combination of features. Firstly, the reservoir of cut tobacco is divided into two physically-separate zones which are out of communication one with another, the trimmed tobacco is recycled to one only of the reservoir zones and fresh cut tobacco is fed only to the other of the reservoir zones. Secondly, tobacco is metered continuously from both reservoir zones at the same rate per unit width of reservoir zone to provide the metered flow and the level of recycled trimmed tobacco in the one reservoir zone is continuously monitored. Thirdly, the rate of metering of tobacco from the reservoir is controlled so as to maintain the level of recycled trimmed tobacco in the one reservoir zone between predetermined levels by decreasing the rate of metering for sensed trimmed tobacco levels above a predetermined upper level and by increasing the rate of the metering for sensed trimmed tobacco levels below a predetermined lower level.

In this way, the sensed level of recycled trimmed tobacco is the sole control parameter for the feed of tobacco to the rod-forming procedure and the necessity to make measurements on the tobacco filler rod, before or after trimming, or of reservoir levels for new cut tobacco, as suggested in the prior art, is avoided. A novel and much simplified tobacco flow rate control procedure is provided thereby.

The present invention also includes a novel cut tobacco hopper device for use in conjunction with a cigarette-making machine, which comprises a reservoir vessel having an upper inlet for tobacco and a lower outlet and having divider means located therein separating the interior of the reservoir vessel into side-by-side vertically-extending physically-separate reservoir chambers, and common metering and feeding means located in operative relationship with the lower outlet for metering and feeding tobacco from the reservoir chambers at the same rate per unit reservoir zone width.

The reservoir vessel, therefore, is divided vertically into two chambers, the one usually narrow and the other usually wide, recycled trimmed tobacco is fed to a narrow chamber, the height of tobacco in the narrow chamber is sensed, and the flow rate of tobacco per unit width of resevoir from both chambers is speeded up or slowed down in response to predetermined "too-low" or "too-high" levels in the narrow chamber. In addition, the width of the narrow chamber in relation to the width of the wide chamber may be used to determine the degree of trimming.

Control of the rod-forming operation in accordance with the present invention is simple yet very effective. As noted earlier, in most machines the feeder speed (i.e. refuser roll metering) is not normally continuously controlled and, as a result of variations in density, the moisture content of the tobacco, particle size etc., variable flow rates of tobacco occur, leading to variations in quantities of tobacco trimmed. By controlling the flow rate in absolute terms by monitoring the amount of tobacco trimmed and recycled, these prior art problems are overcome.

BRIEF DESCRIPTION OF DRAWINGS

The accompanying drawing is a schematic representation of one embodiment of a cigarette-making apparatus embodying the principles of the invention.

DESCRIPTION OF PREFERRED EMBODIMENT

Referring to the drawing, there is illustrated therein a cigarette-making machine 10 constructed in accordance with one embodiment of the invention. In the illustrated embodiment, a tobacco feed is provided for a filler rod-forming mechanism 12, wherein a tobacco filler rod 14 is formed from substreams of tobacco by layering of the same one on another on the periphery of a vacuum wheel 16. The substreams are formed on vacuum wheels 18 from a falling stream or shower 20 of separated tobacco particles. The rod-forming mechanism 12 is fully described in U.S. Pat. No. 3,980,088 and reference may be made thereto for details of the construction and operation. The rod-forming mechanism 12 is provided with a trimmer 22 to remove excess tobacco from the rod 14.

While the present invention is illustrated and described with reference to the filler rod-forming mechanism 12, the principles of the manner of formation of the tobacco feed for the rod former and its manner of control are applicable to any rod-forming procedure wherein a tobacco filler rod is formed, directly or indirectly, from a falling or rising stream or shower of substantially-separated tobacco particles.

The falling tobacco shower 20 is formed by permitting tobacco to fall from the end of a conveyor 24 on which is conveyed a thin carpet 26 of opened tobacco particles. A conventional winnowing operation usually is carried out on the thin carpet 26 as the shower 20 is formed to remove heavy tobacco particles. Details of the winnowing have been omitted for clarity.

The tobacco carpet 26 is formed by discharge from a hopper or reservoir device 28 of novel construction. The reservoir device 28 and its principles of construction and operation constitute one aspect of this invention.

The reservoir device 28 has a generally rectangular cross-sectioned tobacco receiving zone which is divided internally into two physically-separate chambers 30 and 32 by a baffle 34. The chamber 32 is of relatively narrow width as compared with the chamber 30. The width of the chamber 32 in comparison with that of the chamber 30 determines and controls the degree of trimming of the tobacco rod 14, as will become apparent from the further description below.

A tobacco separation and discharge device 36 is provided at the upper end of the reservoir device 28 in communication with the wide chamber 30 for receiving cut tobacco conveyed through feed pipe 38 by the application of vacuum by line 40, for separation of the tobacco from the conveying air by a suitable screen 42 and for feeding charges of tobacco so separated from the conveying air by the screen 42 intermittently into the chamber 30.

The discontinuous discharge device 36 may be replaced, if desired, by a continuous discharge device, whereby tobacco fed by feed pipe 38 is continuously discharged into the chamber 30. For this purpose, the interior of the reservoir device 28 is maintained under vacuum and a continuous air lock is required to be included in the structure of the reservoir device 28 to enable tobacco to be continuously discharged from the reservoir chamber 30 to the external atmospheric conditions without loss of the internal vacuum. One suitable structure is illustrated in U.S. Pat. No. 4,446,876 and reference may be had thereto for details of the construction and operation. Alternatively, the discontinuous discharge device 36 may be replaced by a rotary air lock located at the upper end of the device 28, which enables tobacco to be discharged continuously or discontinuously from the feed pipe 38 to the chamber 30, without breaking the internal vacuum. In this alternative, the chamber 30 is at atmospheric pressure. A further alternative is to feed cut tobacco manually to the wide chamber 30.

The feed of tobacco to the chamber 30, either on a discontinuous or continuous basis, using the devices described above, results in the provision of a reservoir of tobacco 44 in the reservoir chamber 30.

A separate tobacco separation and discharge device 46 is provided at the upper end of the reservoir device 28 in communication with the narrow chamber 32 for receiving a recycle feed of tobacco trimmed from the filler rod 14 by the trimmer device 22. The recycle of trimmed tobacco is effected in the illustrated embodiment by air drawn through recycle line 48. Any other convenient feed means may be employed, for example, a conveyor.

In the separation and discharge device 46, which is in the form of a cyclone separator in the illustrated embodiment, tobacco is separated from the conveying air stream and is continuously discharged to the hopper or chamber 32 by a rotary air lock 50 which maintains the vacuum conditions within the device 46 while permitting the tobacco to be discharged to the ambient atmospheric pressure conditions of the chamber 32. Depending on the manner of provision of the conveying air stream in line 48, the rotary air lock 50 may be omitted. Any other suitable separation and tobacco discharge device may be used.

Since tobacco is continuously trimmed from the filler rod 14 by the trimmer 22, and, as described below, the quantity of trimmed tobacco in the chamber 32 is employed as the control parameter, as a practical consideration, the recycle of trimmed tobacco and its discharge to the narrow chamber 32 should be effected continuously, as illustrated.

The recycled trimmed tobacco discharged to the narrow chamber 32 forms a reservoir of tobacco 52 in the narrow chamber 32. Sensors 53 and 54 are provided in association with the narrow chamber 32 to sense "too-high" and "too-low" conditions respectively of the tobacco in the reservoir 52. The tobacco reservoir 52 in the narrow chamber 32 and the tobacco reservoir 44 in the wide chamber 30 provide the sources of tobacco from which the tobacco carpet 26 is formed on the conveyor 24.

At the lower end of the reservoir device 28, there is provided a tobacco metering and opening device 56, which comprises a pair of counter-rotating metering rollers 58 which extend across the width of the reservoir device 28 in communication with the tobacco reservoirs 44 and 52 in both of the chambers 30 and 32. The counter-rotating rollers 58 have a plurality of radially-directed pins 60 which cooperate with each other to meter a desired amount of tobacco from both the reservoirs 44 and 52 simultaneously. The rate of rotation of the pair of rollers 58 determines the amount of tobacco discharged from the reservoir device 28 to the conveyor 26. Since the metering rollers 58 extend across the whole width of the reservoir device 28 and meter tobacco from both chambers 30 and 32, the rate of feed of tobacco from the chambers 30 and 32 is the same per unit width.

The tobacco metering and opening device 56 also includes a third roller 62 generally equidistantly positioned with respect to the pair of rollers 58. The third roller 62 is provided with projecting pins 64 which interdigitate with and cooperate with the pins 60 on the rollers 58 to separate the tobacco metered by the pair of rollers 58 from the reservoirs or sources 44 and 52 into individual tobacco particles which are discharged onto the upper surface of the conveyor 24 to provide the tobacco carpet 26.

The thickness of the carpet 26 on the conveyor 24 and hence the amount of tobacco forming the tobacco shower 20 from which the filler rod 14 is formed is determined by the speed of the conveyor surface 24 and the rate of rotation of the pair of rollers 58. Usually, the speed of the conveyor 24 is maintained constant and the tobacco flow rate then is controlled by the operation of the metering and opening device 56.

As may be seen from the foregoing description, the only tobacco recycled in this system is trimmed tobacco and no refuser mechanism is required or utilized. The tobacco which forms the carpet 26 is positively metered and then discharged in an opened condition from the reservoir device 28 by the tobacco metering and opening device 56 and is in the amount required for rod formation. Tobacco degradation introduced by refuser and metering mechanisms such as are employed in conventional cigarette-making machines is eliminated. The utilization of the hopper 28 not only enables fully-opened relatively-undamaged tobacco to be fed to rod formation but also results in considerable simplification in the elements of construction of a cigarette-making machine.

In the present invention, the recycle of trimmed tobacco by line 48 is used to control the operation of the rod-forming device 12. The rate of feed of tobacco by the metering and opening device 56 from the chambers 30 and 32 is controlled so as to maintain a substantially constant level of the tobacco 52 in the narrow chamber 32.

If the quantity of tobacco in the narrow chamber 32 rises, then the quantity of tobacco being trimmed has risen and, therefore, the cigarette-making machine is operating with an excess of the tobacco required. In response to a rise in the quantity of tobacco in the narrow chamber 32, the feed rate of tobacco from the reservoir device 28 is decreased by slowing down the rate of operation of the metering and opening device 56 until the desired level of recycled tobacco in the narrow chamber 32 is restored.

Similarly, if the quantity of tobacco in the narrow chamber 32 falls, then the quantity of tobacco being trimmed has fallen and, therefore, the cigarette-making machine is operating with a deficiency of tobacco. The feed rate of tobacco from the reservoir device 28 is speeded up to compensate for the inadequate feed rate until the desired level of recycled tobacco in the narrow chamber is restored.

The level of tobacco in the narrow chamber 32 may be sensed in any desired manner, for example, by using optical sensors 53 and 54, and usually variations in tobacco level within a predetermined range, as determined by the spacing of the sensors 53 and 54, are permitted. Through appropriate circuitry, a "too-high" or "too-low" signal may be used to trigger appropriate variation in the speed control 64 for the drive motor 66 for the device 56, which appropriately speeds up or slows down the rate of tobacco feed from the reservoirs 44 and 52.

Using the level of recycled tobacco in the narrow chamber 32 to control the rate of metered tobacco supplied to the rod-forming operation to ensure that the correct quantity of tobaco is present in the filler rod 14, is a very simple yet extremely functional operation. Overfeeding and trimming are required to be effected in cigarette filler rod formation for the reasons discussed above and it is necessary to recycle the trimmed tobacco to ensure economic use of tobacco. The present invention has used these prior art operations in a unique and useful manner, to control the rod-forming operation.

The recycle of trimmed tobacco also has been uniquely combined into a procedure of forming the feed to filler rod formation which does not involve any refuser mechanism and/or recycle procedure, other than the recycle of trimmed tobacco, and so the present invention has eliminated the tobacco degradation which results during conventional feed-forming procedures.

The degree of trimming of tobacco from the filler rod 14 also may be controlled, in accordance with one embodiment of the invention. The degree to which trimming of a filler rod 14 is required to be effected to remove the variations in tobacco thickness along the length of the rod depends on a number of factors, including the nature of the rod-forming operation.

In this embodiment of the invention, the degree of trimming is controlled by the width of the narrow chamber 32. As the transverse dimension of the chamber 32 is narrowed, less tobacco is required to maintain the desired level of tobacco 52 in the narrow chamber 32 and hence a lesser amount of tobacco needs to be recycled by line 48. Similarly, as the transverse dimension of the chamber 32 is widened, more tobacco is needed to maintain the desired level of tobacco 52 in the narrow chamber 32 and hence a greater amount of tobacco is required to be recycled by line 48.

The width of chamber 32, therefore, is preset to the desired degree of trimming having regard to the predetermined speed of operation of the cigarette rod-forming procedure and then that degree of trimming is maintained by maintaining the predetermined level of recycled trimmed tobacco 52 in the narrow chamber 32.

In the illustrated embodiment, the trimmed tobacco is positioned adjacent the rod-forming surface of the wheel 16. It is also possible and preferred to arrange the apparatus 10 to provide the recycled trimmed tobacco on the exterior surface of the filler rod 14 and hence on the side of the filler rod opposite to the rod-forming surface of the wheel 16. In this way, the already-trimmed tobacco once again is trimmed and overall tobacco degradation thereby is minimized and an improved distribution of shorts across the width of the filler rod is achieved, since the increased quantity of shorts in the trimmed tobacco offsets the normal concentration of shorts towards the rod-forming surface.

SUMMARY OF DISCLOSURE

In summary of this disclosure, the present invention provides a novel manner of controlling cigarette filler rod-forming procedures by controlling the rate of recycle of trimmed tobacco. This recycle operation preferably is combined with and renders effective a novel tobacco feeding procedure which enables a feed for a filler rod-forming operation to be provided without resulting in tobacco degradation from refuser and recycle operations. The degree of trimming may also be controlled by this invention. Modifications are possible within the scope of this invention.

What I claim is:

1. In a method of forming a tobacco filler rod suitable for the formation of cigarettes therefrom wherein cut tobacco is metered from a reservoir thereof to provide a metered flow, a vertically-moving shower of tobacco particles is formed from said metered flow, a rod of tobacco particles is formed from said shower and contains a greater quantity of tobacco in the cross-section thereof than is required in said tobacco filler rod, excess tobacco is trimmed from said rod of tobacco particles to provide said tobacco filler rod and trimmed tobacco, and said trimmed tobacco is recycled to said reservoir of cut tobacco, the improvement wherein:

said reservoir of cut tobacco is divided into two physically-separate zones which are out of communication one with another, said trimmed tobacco is recycled to one only of said reservoir zones and fresh cut tobacco is fed only to the other of said reservoir zones, tobacco is metered continuously from both said reservoir zones at the same rate per unit width of reservoir zone to provide said metered flow and the level of recycled trimmed tobacco in said one of said reservoir zones is continuously monitored, and the rate of metering of tobacco from said reservoir is controlled so as to maintain the level of recycled trimmed tobacco in said one of said reservoir zones between predetermined levels by decreasing the rate of said metering for sensed trimmed tobacco levels above a predetermined upper level and by increasing the rate of said metering for sensed trimmed tobacco levels below a predetermined lower level.

2. The method of claim 1 wherein said one reservoir zone is of narrow width and said other reservoir zone is of significantly broader width.

3. The method of claim 2 wherein said tobacco is metered continuously from both reservoir zones by a pair of metering rollers which extend across the whole width of the reservoir and are in communication with the lower end of both reservoir zones and said rate of metering of tobacco is determined by the rate of rotation of the metering rollers.

4. The method of claim 3 wherein an opening roller is associated with the metering rollers to open the metered flow of tobacco from the rollers to provide a broad carpet of opened tobacco on a conveying surface, and said shower of tobacco particles if formed from the carpet of opened tobacco particles.

5. The method of claim 2 wherein said tobacco trimmed from the rod of tobacco particles comprises tobacco trimmed and recycled in a previous trimming step.

6. A cut tobacco hopper device for use in conjunction with a cigarette making machine, which comprises:

a reservoir vessel having an upper inlet for tobacco and a lower outlet and having divider means located therein separating the interior of the reservoir vessel into side-by-side vertically-extending physically-separated reservoir chambers which are out of communication one with another, and common metering and feeding means located in operative relationship with the lower outlet for metering and feeding tobacco simultaneously from both said reservoir chambers through said lower outlet at the same rate per unit reservoir width.

7. The device of claim 6 wherein said divider means is located to provide a first reservoir chamber of narrow width and a second reservoir chamber of significantly broader width.

8. The device of claim 7 wherein individual tobacco feed devices are provided one in independent communication with each of reservoir chambers through said upper inlet.

9. A cut tobacco hopper device for use in conjunction with a cigarette making machine, which comprises:

a reservoir vessel having an upper inlet for tobacco and a lower outlet and having divider means located therein separating the interior of the reservoir vessel into side-by-side vertically-extending physically-separated reservoir chambers comprising a first reservoir chamber of narrow width and a second reservoir chamber of significantly broader width, and common metering and feeding means located in operative relationship with the lower outlet for metering and feeding tobacco from reservoir chambers at the same rate per unit reservoir zone width, said common metering and feeding means comprising a pair of metering rollers extending across the width of the reservoir vessel in communication with the lower outlet and an opening roller extending across the width of the reservoir vessel below the pair of metering rollers.

10. In a cigarette making machine comprising a tobacco hopper for receiving and storing cut tobacco until required for cigarette making, vertical tobacco shower-forming means for forming a vertically-flowing shower of separated tobacco particles form cut tobacco stored in said hopepr, and tobacco filler rod-forming means for forming a tobacco filler rod suitable for cigarette making from said shower of separated tobacco particles including trimming means for trimming excess tobacco from a rod of tobacco particles to proivde said filler rod, the improvement which comprises:

cut tobacco receiving vessel means having an upper inlet for receipt of tobacco therein and a lower outlet for the discharge of tobacco therefrom, said vessel having a vertically-extending baffle means therein dividing the interior of said vessel means into a narrow vertically-extending chamber and a significantly wider vertically-extending chamber, said wider chamber constituting said tobacco hopper for receiving and storing cut tobacco, feed means for feeding tobacco trimmed by said trimmer means to said narrow chamber, metering and feeding means located at said lower outlet from said receiving vessel means for simultaneously discharging tobacco from said narrow and wider chambers, and conveyor means constituting part of said shower-forming means for receiving tobacco discharged by said metering and feeding means as a carpet of tobacco thereon.

11. The apparatus claimed in claim 10, wherein said metering and feeding means comprises a pair of metering rollers extending across the width of said receiving vessel means for metering tobacco from the lower end of both said narrow and wider chambers at a rate proportional to the speed of rotation of said metering rollers, and a third opening roller operatively associated with said metering rollers to open tobacco metered by said metering rollers from said receiving vessel means and discharge the opened tobacco to the conveyor means to provide said carpet of tobacco thereon.

12. The apparatus of claim 11, wherein receiving vessel means is adapted to be maintained under a vacuum and said metering and feeding means includes rotary air lock means to enable said opened tobacco to be continuously discharged from the vacuum environment without loss of vacuum.

13. The apparatus of claim 11 including tobacco level sensor means associated with said narrower vessel to sense levels of tobacco therein above and below predetermined levels, and means for varying the speed of rotation of said metering rollers, so as to vary the feed rate of tobacco from both said narrow and wider chambers in response to sensed undesired higher or lower levels of tobacco in said narrow chamber.

14. The apparatus of claim 11 wherein said narrow chamber is located so that trimmed tobacco received therein comprises tobacco previously trimmed from the filler rod.

15. The apparatus of claim 10 wherein said trimmed tobacco feed means comprises conveyor means for conveying trimmed tobacco from said trimmer means to the portion of said upper inlet associated with said narrow chamber, and continuous discharge means for continuously discharging said trimmed tobacco conveyed to said narrow chamber.

16. The apparatus of claim 13 including cut tobacco discharge means operatively associated with the portion of said upper inlet associated with said wider chamber for the discharge to said wider chamber of cut tobacco conveyed by vacuum to said discharge means.

17. The apparatus of claim 16 wherein said cut tobacco discharge means is constructed to effect said discharge continuously or discontinuously to said wider chamber.

18. The apparatus of claim 17 wherein said tobacco discharge means is constructed to maintain said vacuum conveying of cut tobacco continuously and said wider chamber is constructed to maintain tobacco contained therein under atmospheric pressure conditions.

* * * * *